US007527455B2

(12) United States Patent
Raines

(10) Patent No.: US 7,527,455 B2
(45) Date of Patent: May 5, 2009

(54) ANCHOR INSTALLATION SYSTEM

(75) Inventor: Richard D. Raines, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 564 days.

(21) Appl. No.: 10/541,150

(22) PCT Filed: Feb. 17, 2004

(86) PCT No.: PCT/US2004/004568

§ 371 (c)(1),
(2), (4) Date: Jun. 30, 2005

(87) PCT Pub. No.: WO2004/078576

PCT Pub. Date: Sep. 16, 2004

(65) Prior Publication Data

US 2006/0127187 A1 Jun. 15, 2006

Related U.S. Application Data

(60) Provisional application No. 60/451,823, filed on Mar. 4, 2003.

(51) Int. Cl.
*E02D 15/08* (2006.01)
*E02D 5/22* (2006.01)
*B63B 21/27* (2006.01)

(52) U.S. Cl. ..... 405/228; 405/224.1; 114/296

(58) Field of Classification Search ..... 405/224, 405/224.1, 228; 114/294, 295, 296
See application file for complete search history.

(56) References Cited

U.S. PATENT DOCUMENTS 12,130 A * 1/1855 Holmstrom ..... 405/192
3,210,897 A * 10/1965 Whittington ..... 405/244
3,314,241 A * 4/1967 Mayhall ..... 405/228
3,496,900 A 2/1970 Mott et al. ..... 114/206
3,800,548 A * 4/1974 Wisotsky ..... 405/228
3,817,040 A 6/1974 Stevens ..... 61/53.5
3,969,853 A 7/1976 Dieke ..... 52/156
4,318,641 A * 3/1982 Hogervorst ..... 405/224
4,575,282 A 3/1986 Pardue, Sr. et al. ..... 405/228
4,619,218 A 10/1986 Kenny ..... 114/295
5,033,908 A 7/1991 Auraen ..... 405/204
5,704,732 A 1/1998 Horton, III ..... 405/228
5,915,326 A 6/1999 Karal ..... 114/294
6,132,145 A * 10/2000 Treu et al. ..... 405/224

(Continued)

FOREIGN PATENT DOCUMENTS

GB 1 269 599 4/1972

(Continued)

OTHER PUBLICATIONS

PCT International Preliminary Report on Patentability, mailed Apr. 27, 2006, for PCT/US04/04568 (2003UR005), 5 pages.

(Continued)

*Primary Examiner*—Michael Safavi

(57) ABSTRACT

A system and method for installing a pile anchor (75) using an anchor installation system (100). The anchor installation system comprising an elongated hollow anchor element (75) that is releasably attached to an installation element or installer (50). The installer can be used repeatedly for multiple installations.

40 Claims, 5 Drawing Sheets

U.S. PATENT DOCUMENTS

| | | | | |
|---|---|---|---|---|
| 6,309,269 | B1 | 10/2001 | Fulton et al. | 441/1 |
| 6,457,908 | B1 | 10/2002 | Bergeron | 405/224 |
| 6,461,084 | B1 | 10/2002 | Stuart | 405/244 |
| 6,719,496 | B1 | 4/2004 | Von Eberstein | 405/224 |

FOREIGN PATENT DOCUMENTS

| | | |
|---|---|---|
| GB | 2 368 329 | 5/2002 |
| WO | WO 2004/079100 A2 | 9/2004 |
| WO | WO 2004/079100 A3 | 9/2004 |

OTHER PUBLICATIONS

Abstract for JP58-149886; Sep. 1983.
European Search Report RS 110208 for U.S. Appl. No. 60/451,823, mailed Oct. 13, 2003, 3 pages.
International Search Report and Written Opinion for PCT/US04/04568 (2003UR2005), mailed Feb. 24, 2005, 8 pages.

* cited by examiner

ANCHOR INSTALLATION SYSTEM

CROSS REFERENCE TO RELATED APPLICATIONS

This application is the National Stage of International Application No. PCT/US04/04568, filed Feb. 17, 2004, which claims the benefit of U.S. Provisional Application 60/451,823, filed Mar. 4, 2003.

FIELD OF THE INVENTION

This invention relates generally to pile anchor technology and in particular to a novel anchor installation system that can be used for mooring offshore structures, such as, but not limited to, floating structures, DDCV's, drilling or production risers, pipelines semi-submersibles, drilling vessels, subsea structures and other structures used in the offshore petroleum industry.

BACKGROUND OF THE INVENTION

Offshore structures, such as those used by the petroleum industry, are sometimes moored to the seafloor using pile anchors. Existing pile anchors may generally be described as a single tubular element, typically circular in cross section, with a closed top and an open bottom. The ability of a pile anchor to moor an object is typically referred to as an anchor's "holding capacity." In general, the holding capacity of a pile anchor increases with the size of the anchor. However, typically as the size of the anchor increases, so does the anchor's material, fabrication and installation costs. Additional background can be found in U.S. Pat. No. 5,915,326 to Karal, GB 2,368,329 A to Baross et al., U.S. Pat. No. 5,704,732 to Horton, and JP 58 149,866 to Koji appearing in Patent Abstracts of Japan vol. 007, no. 271 (3 Dec. 1983). What is needed is a pile anchor installation system that reduces the high costs of material, fabrication and installation without substantially reducing the anchor's holding capacity. The current invention satisfies this need.

SUMMARY OF THE INVENTION

The invention includes an anchor installation apparatus. The apparatus includes a first elongated hollow element, a second elongated hollow element, and a pipe end to pipe end connector or means for releasably connecting the first elongated hollow element to the second elongated hollow element. The first elongated hollow element may have a closed upper end, an open lower end, and a transverse cross section. The second elongated hollow element may have an open upper end, an open lower end, and a transverse cross section substantially the same as that of the first hollow element. The pipe end to pipe end connector is used for releasably connecting the open lower end of the first elongated hollow element to the open upper end of the second elongated hollow element. The anchor installation system may also include a valve or means for regulating fluid flow. The valve may be attached to the closed upper end of the first elongated hollow element and the valve is adapted to regulate the flow of fluid from one side of the closed upper end to the other side of the closed upper end of the first elongated hollow element. The anchor installation system may also include an attachment device or load transfer means fixed to the outer surface of the second elongated hollow element. The attachment device or load transfer means may be used to attach cables or chains to the second elongated hollow element which may further be connected to the offshore structure to be anchored.

Another embodiment of the invention is a method for installing an anchor into the floor of a body of water. The method includes installing an elongated hollow element anchor into the floor of the body of water through use of an anchor installation system. The anchor installation system includes a first elongated hollow element, a second elongated hollow element anchor and a pipe end to pipe end connector or means for releasably connecting the first elongated hollow element to the second elongated hollow element. The method may include using an anchor installation system which also includes a valve or means for regulating fluid flow and/or an attachment device or load transfer means. The first elongated hollow element, valve or means for regulating fluid flow, second elongated hollow element anchor, pipe end to pipe end connector or means for releasably connecting, and attachment device or load transfer means are as described in the preceding paragraph. The method includes releasing the first elongated hollow element from the second elongated hollow element. The method may also include retrieving the first elongated hollow element. As in the preceding paragraph, the load transfer means may be used to attach cables or chains to the second elongated hollow element which may further be connected to the offshore structure to be anchored as described in the preceding paragraph.

Another embodiment of the invention provides a method of producing offshore hydrocarbon resources. The method includes anchoring an offshore structure to the seabed through use of an anchor installation system. The anchor installation system includes a first elongated hollow element having a closed upper end, an open lower end, and a transverse cross section, a second elongated hollow element having an open upper end, and open lower end, and a transverse cross section substantially the same as that of the first elongated hollow element, a load transfer device fixed to the outer surface of the second elongated hollow element, and a pipe end to pipe end connector for releasably connecting the open lower end of the first elongated hollow element to the open upper end of the second elongated hollow element. The method further includes releasing the first elongated hollow element from the second elongated hollow element, connecting the load transfer device to an offshore structure, and producing hydrocarbon resources. The anchor installation system may also include a valve for regulating fluid flow attached to the closed upper end of the first elongated hollow element.

DESCRIPTION OF THE INVENTION

As used herein and in the appended claims the phrase "elongated hollow element" is meant to refer to any device that forms an enclosure on all its sides except that its top and bottom ends may be open or closed with a cap. For example, by way of illustration and not limitation, a circular, rectangular or elliptical conduit with a closed or open top and lower end. An elongated hollow element may be completely hollow within its interior or may be only partially hollow, for example including internal structural bracing within the elongated hollow element. The elongated hollow elements according to the invention may have an open lower end.

As used herein and in the claims the phrase "pipe end to pipe end connector" is meant to refer to any device or method of connecting one end of an elongated hollow element to one end of a second elongated hollow element. For example, a gravity connector, a threaded screwed connector, or a mechanical connector that includes moving mechanical parts. More particular examples include a slip joint, stabbing guide, threaded pipe, steel cables, mechanical latches, and couplings.

In general, pile anchors may be installed by being lowered into the soil in a controlled descent, with the weight of the anchor being the initial driving force. Cables may be used to help control the descent of the pile anchor, and pressure release mechanisms, such as two-way flow valves on the pile anchor, are opened to allow water to evacuate from the interior of the pile anchor, thereby allowing penetration of the pile anchor into the soil. This process is referred to as self-weight penetration. Usually self-weight penetration is followed by applying another force on the anchor to obtain the final penetration depth. Typically, this force is applied by way of suction penetration. In suction penetration, a water evacuation pump may be attached to the suction pile anchor and water is pumped out from the anchor's interior while maintaining a seal between the lower end of the pile anchor and the seabed soil such that there is little or no flow into the pile anchor. The differential water pressure that is created results in a net downward force that is used to push the suction pile anchor to final penetration. A direct force can also be applied on the anchor, such as using a pile-driving hammer, to achieve final penetration. The direct force can be used either alone or in combination with suction penetration.

Figure 1:
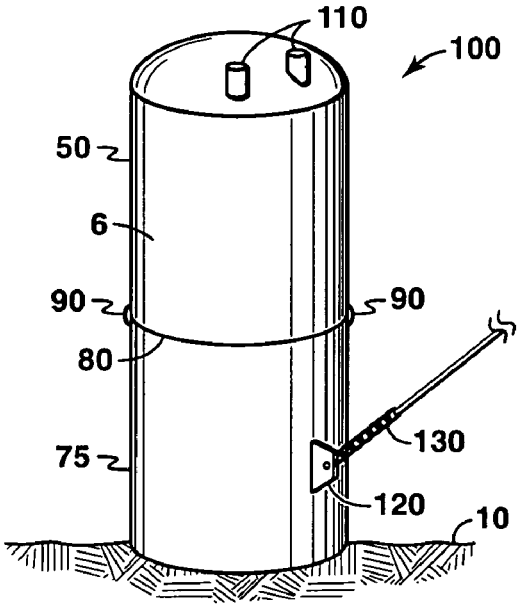
FIG. 1 illustrates one embodiment of an anchor installation system.

One embodiment of the novel anchor installation system (100) of this invention is shown in FIG. 1. In this embodiment, the anchor installation system (100) takes the general configuration of a tubular suction pile anchor that has been divided into two-pieces: a top piece called the installer (50) and a bottom piece called the anchor (75), which is releasably connected to the installer (50). The releasable connection between the installer (50) and the anchor (75) can be made by a gravity connection, such as a slip joint (80) or stabbing guide. The slip joint configuration is more particularly displayed in FIGS. 2, 3 and 4. In addition or in the alternative, the installer (50) and anchor (75) can be held in place during deployment with steel cable connectors (90) that connect the lower end of installer (50) and the upper end of anchor (75). Those skilled in the art will recognize that other pipe end to pipe end connectors can also achieve the intended objective. The installer (50) may be equipped with one or a plurality of two-way valves (10). The anchor (75) may be equipped with an attachment device or means, for example a padeye (120), so that a load may be secured by the anchor (75) through use of a cable, for example, a steel chain (130). The anchor installation system (100) may be used to secure an offshore structure (not shown), such as a floating structure, DDCV, drilling or production riser, pipeline, semi-submersible, drilling vessel, subsea structure, or other structure.

Figure 2:
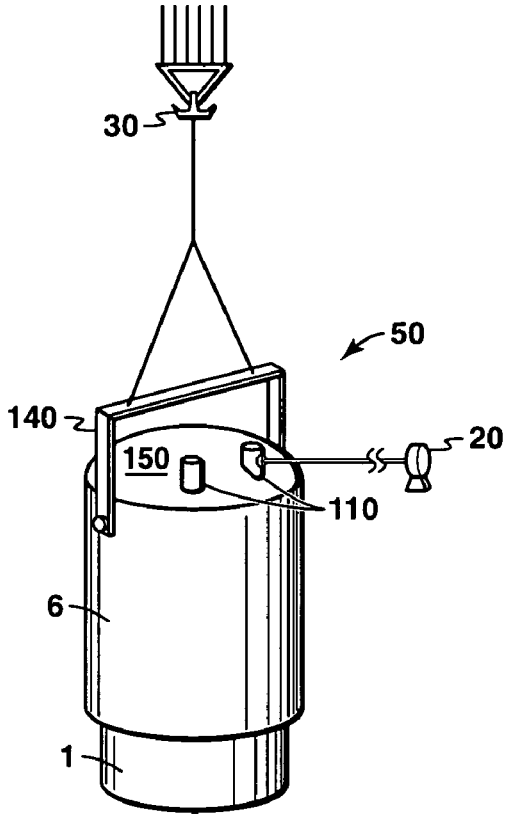
FIG. 2 illustrates one embodiment of an installer.

As shown in FIG. 2, the installer (50) may be a cylindrical body that is closed at the top by a cap (150), and open at its lower end. However, the installer (50) can be fabricated in other geometric configurations such as an elliptical cylinder, 3-D rectangle, various conduit-shaped configurations or other elongated hollow element configurations. The slip joint of the installer (50) may be formed by the arrangement of an inner elongated hollow element (1) situated within the outer elongated hollow element (6). In this arrangement the outer diameter of the installer's (50) inner elongated hollow element (1) is approximately the same or slightly less than the inner diameter of the outer elongated hollow element (6) such that the inner elongated hollow element (1) fits within the outer elongated hollow element (6). The inner hollow elongated hollow element (1) is attached within the outer hollow elongated element (6) by, for example, a weld or other attachment process known in the art. The inner elongated hollow element (1) should extend down from the outer elongated hollow element (6) such that its lower end is exposed as depicted in FIG. 2. It is this exposed end of the inner elongated hollow element (1) that will slip inside of the anchor (75) depicted in FIGS. 3 and 4 to form a seal between the installer (50) and anchor (75) when they are fit together.

Cap (150) may contain two way flow valves (110). Water evacuation pump (20) can be releaseably connected to a flow valve (110) on the cap (150) of installer (50) to enable suction installation, as previously discussed. During the installation process, the installer (50) may be supported by deployment hardware such as spreader bar (140), which in turn can be supported by a crane or other surface machinery through crane hook (30).

Figure 3:
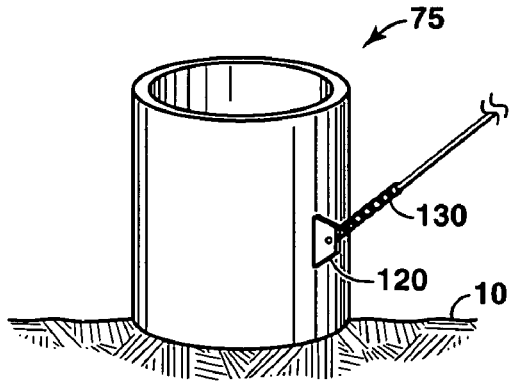
FIG. 3 illustrates one embodiment of an anchor.
Figure 4:
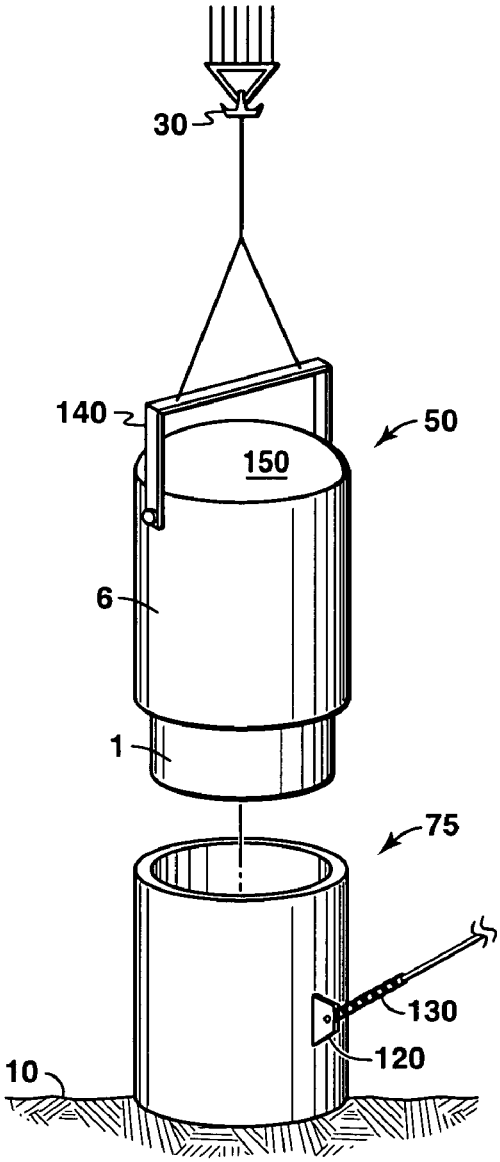
FIG. 4 illustrates one embodiment of an anchor installation system showing one way that an installer can connect to an anchor.

Referring now also to FIG. 3, the anchor (75) has substantially the same transverse (i.e., perpendicular to the longitudinal axis) cross-section as the installer (50). In FIG. 3, anchor (75) is shown as a cylindrical body, which is open at its top and bottom. However, the anchor (75) can be fabricated in other geometric configurations such as an elliptical cylinder, 3-D rectangle, various conduit-shaded configurations or other elongated hollow element configurations. A relatively tight seal may be formed between anchor (75) and installer (50) (when connected) to prevent influx of water during suction installation. During suction installation a seal is also formed between the lower end of the anchor (75) and the soil of the seabed (10). Typically, an attachment device, for example, a padeye, (120) is located to the side of the anchor (75) as a connection point for an anchor chain (130), which transfers the load from the offshore structure being moored. The size of the anchor (75) and installer (50) can be determined by one of ordinary skill in the art based upon the soil conditions and load requirements for the particular application.

The anchor (75) of the anchor installation system (100) of the current invention can be installed using standard techniques for installing pile anchors, i.e. through self-weight penetration, suction penetration, other types of direct force, or a combination thereof, as previously described. After the anchor (75) has penetrated a prescribed distance below the seafloor (10), the installer (50) is disengaged from the anchor (75) and retrieved. After the installer (50) is retrieved, another anchor (75) can be releasably connected to the installer (50)

and the process repeated. Accordingly, the installer (50) can be used to install a plurality of anchors (75).

In one embodiment of the installation process, the installation system (100) is inserted into the seafloor (10), and a remotely operated vehicle (ROV) is used to cut and/or remove the steel cable connectors (90) prior to the lower end of the installer (50) reaching the seafloor (10). Compressive forces acting on the installation system (100) during installation should prevent premature separation of the installer (50) and anchor (75) until the final penetration depth is achieved. After final penetration is achieved, the installer (50) can be retrieved by reversing the flow of the water through evacuation pump (20) into the installer (50) through flow valve (110), thereby pushing the installer (50) out of the seafloor soil (10).

Figure 5A:
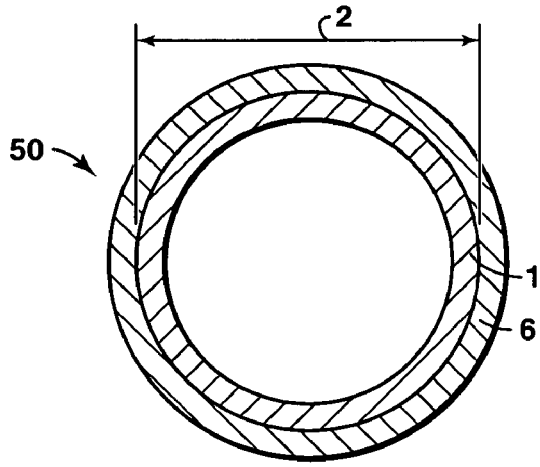
FIG. 5 illustrates a bottom view of an installer and a top view of an anchor.
Figure 5B:
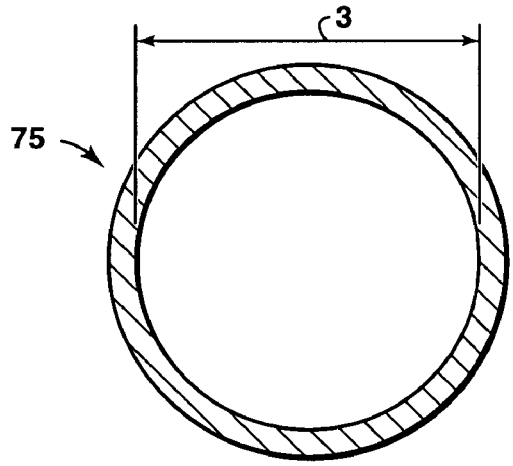
Figure 6A:
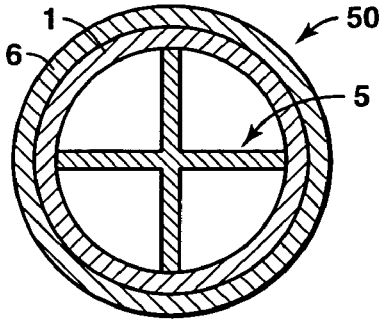
FIG. 6 illustrates alternate bottom views of installers and top views of anchors.
Figure 6C:
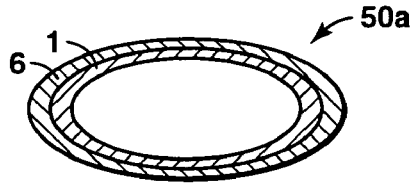
Figure 6B:
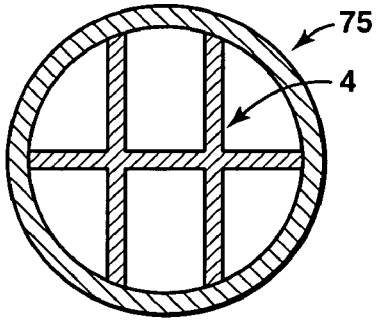
Figure 6D:
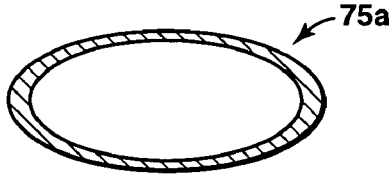
Figure 6E:
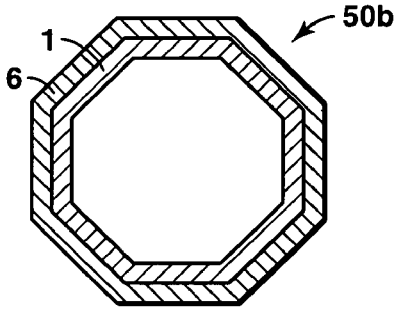
Figure 6G:
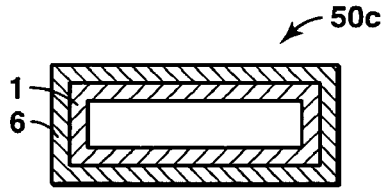
Figure 6F:
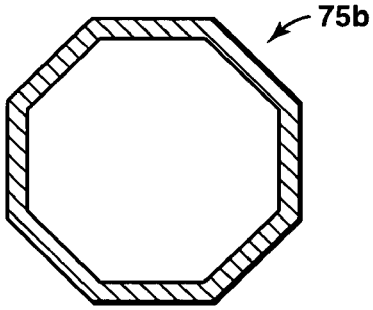
Figure 6H:
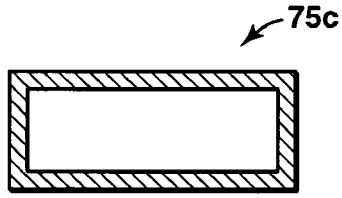

FIG. 5 depicts a bottom view of the installer (50) above a top view of the anchor (75). In this view it can be seen that the outer diameter (2) of the inner elongated hollow element (1) fits within the inner diameter (3) of the anchor (75) such that a seal may be formed when the lower end of the installer (50) is connected to the upper end of the anchor (75).

FIG. 6 depicts several different geometries of installers (50, 50*a*, 50*b*, and 50*c*) and anchors (75, 75*a*, 75*b*, and 75*c*). Installer (50) is also depicted with internal support bracing (5) which may reinforce the walls of the inner elongated hollow element (1) thereby also reinforcing the walls of the outer elongated hollow element (6). Similarly anchor (75) is depicted with support bracing (4).

Figure 7:
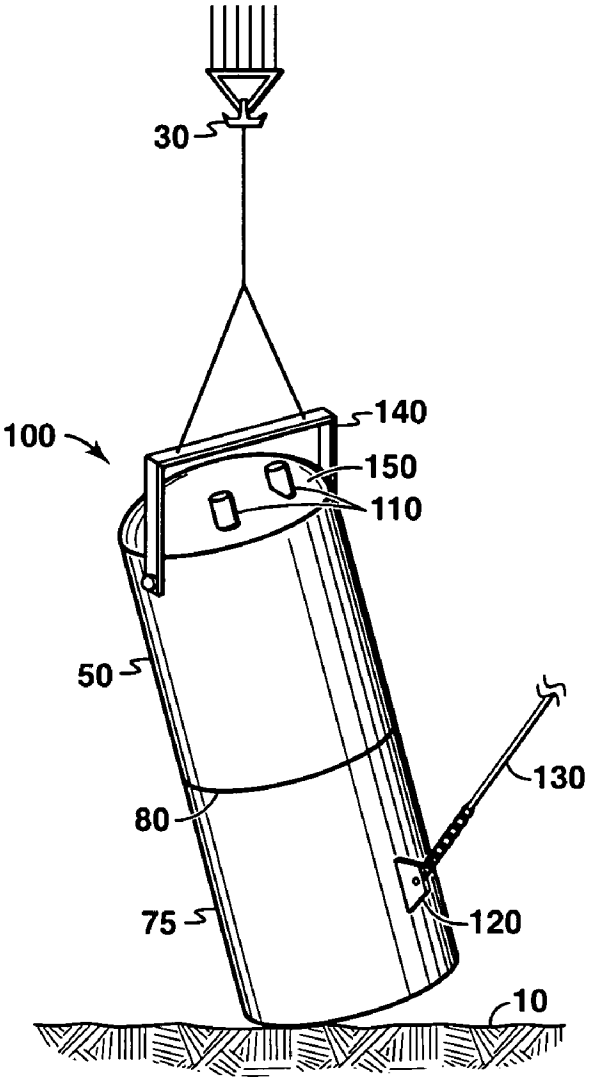
FIG. 7 illustrates one embodiment of an anchor installation system wherein the anchor is installed at an inclined angle with respect to the seafloor.

Referring now to FIG. 7, in an alternative use the novel anchoring system (100) of the current invention is installed in conjunction with the novel installation method in which the top of the anchor is angled away from the direction of the lateral loading as disclosed in co-pending U.S. patent application Ser. No. 10/382,291, filed Mar. 5, 2003, titled Method for Installing a Pile Anchor, the entirety of which is hereby incorporated by reference herein. In this embodiment, the anchor installation system (100) is positioned at an inclined angle with respect to the sea floor, with the top of the anchor installation system (100) inclined in a direction away from the direction of lateral loading, and then inserted at least partially into the seafloor while the angle of inclination is substantially maintained. The present invention therefore also includes a method for installing a pile anchor into a sea floor, and in one alternative, the invention permits reducing or eliminating the vertical load acting upon the anchor (75) and correspondingly increasing the lateral load component, thereby enhancing the anchor's holding capacity. An elongated hollow element, such as the pile anchor (75), embedded in a typical sea floor (10) stratigraphy can achieve a higher holding capacity when it is displaced through the soil perpendicular to its longitudinal axis, as opposed to displacement along its longitudinal axis. These load components represent lateral soil resistance (bearing resistance) and vertical soil resistance (sliding frictional resistance), respectively. The method for deploying the pile anchor described herein will permit the pile anchor (75) to be installed so the vertical load component can be reduced incrementally, or completely eliminated.

As described in the above-referenced co-pending U.S. patent application, an alternate embodiment of the invention, where the anchor (75) is installed at an angle, includes the anchor installation system (100) being installed using a guide frame to create and maintain the desired angle of inclination. In another embodiment of the invention, the desired angle of inclination is created and maintained by connecting a tensioning device to provide upward tension to the side of the anchor installation system (100) on which the lateral load connection is applied, i.e., padeye (120). For example, anchor chain (130) may serve as the tensioning device for this embodiment. Alternative tensioning devices can be used, which include but are not limited to a lifting cable, or bar (or other rigid member). Another embodiment of this invention provides an anchor installation system (100) with internal compartments that can be selectively evacuated of water to provide selective buoyancy for the anchor installation system (100). By selectively adjusting the buoyancy of the anchor installation system (100), the desired angle of inclination can be achieved during installation. In another embodiment the spreader bar (140) or other deployment hardware is attached to the anchor installation system (100) at an offset position so that the axis of rotation is not through the center of gravity of the anchor installation system (100). The spreader bar (140) or other deployment hardware is positioned such that the anchor installation system (100) naturally assumes the desired angle of inclination when it is deployed. Rigging cables or slings may be employed in these embodiments to steady the anchor installation system (100) during lowering and initial insertion into the sea floor (10).

The installation method disclosed above and in the above-referenced U.S. patent application enhances the anchor's holding capacity. Accordingly, installation of the novel anchor installation system (100) in conjunction with the method disclosed in the above-referenced U.S. patent application may provide an anchor (75) that can maintain the same holding capacity at a reduced size.

Figure 8:
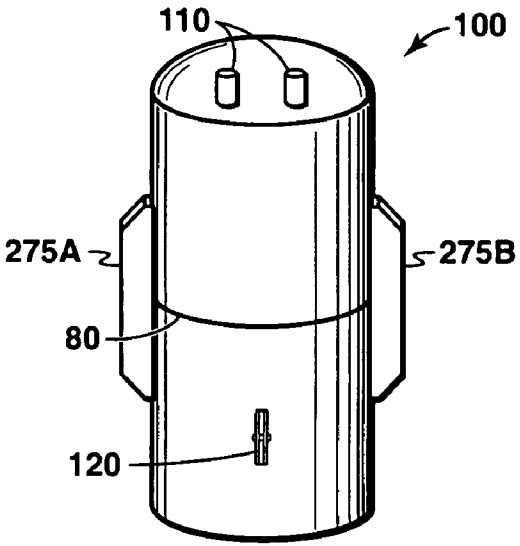
FIG. 8 illustrates an anchor installation system with vanes.

In another embodiment shown in FIG. 8, the installer (50) or the anchor (75) or both have longitudinally disposed vanes, (275A) and (275B), attached to the exterior of the respective elongated hollow elements. The externally disposed vanes help maintain the anchor's heading and bearing during the installation process and can also enhance the anchor's holding capacity as disclosed in co-pending U.S. Provisional Patent Application No. 60/451,734, titled Pile Anchor with External Vanes, filed on Mar. 4, 2003, the entirety of which is hereby incorporated by reference herein.

Figure 9:
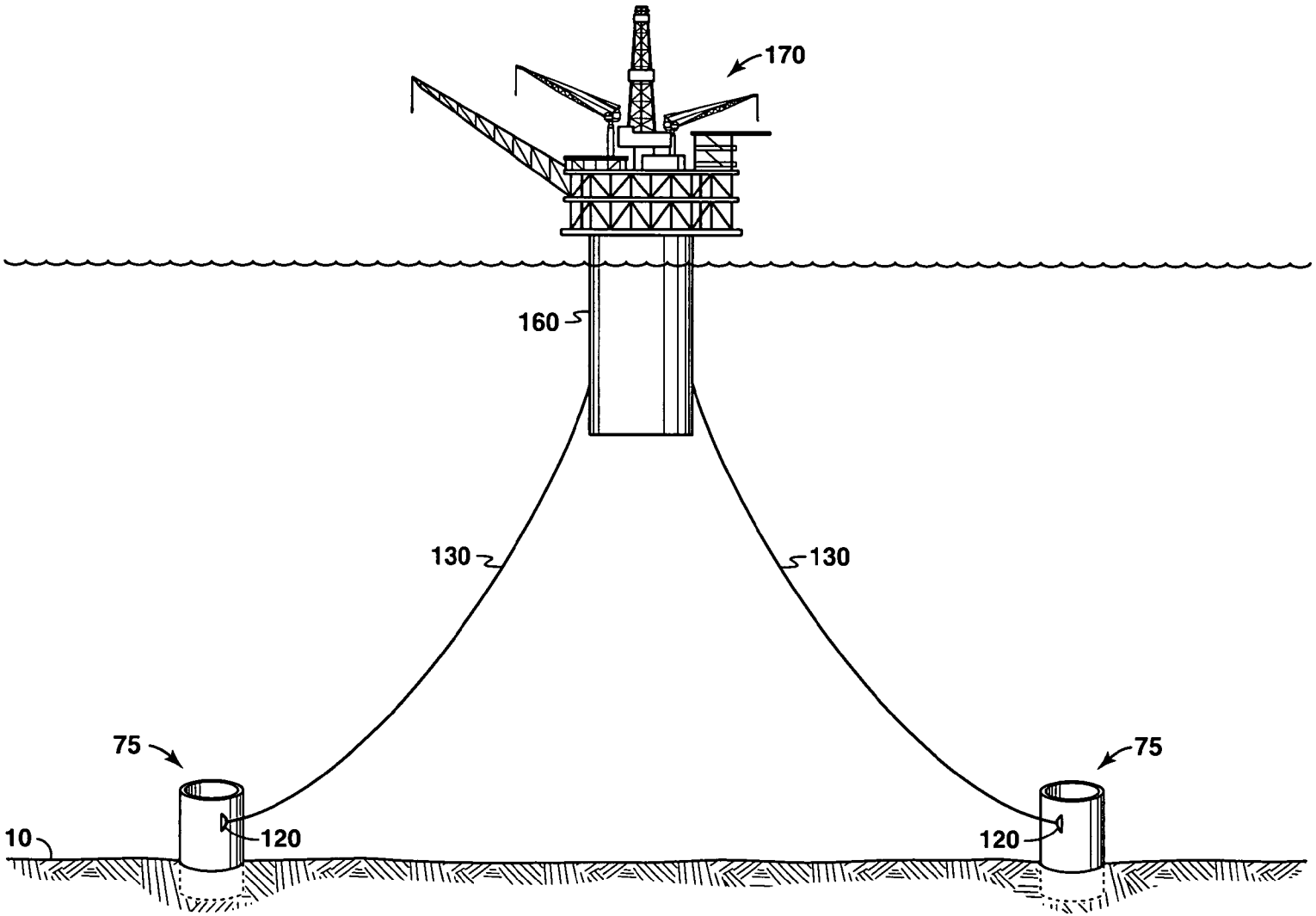
FIG. 9 illustrates an offshore spar that is anchored using the anchors of the invention.

FIG. 9 depicts an embodiment of the invention where pile anchors (75) are used to anchor an offshore structure (160) through use of anchor chains (130) connected to such pile anchors (75) through use of an attachment apparatus (120). The offshore structure (160) may be for example a spar (e.g. a deep draft caisson vessel ("DDCV") or a truss spar) that is equipped with a deck (170). The deck (170) can support offshore hydrocarbon resource (i.e. oil and gas) exploration, drilling and production operations. The deck may be use to conduct offshore seismic data collection. Alternatively, the deck can support offshore drilling equipment for oil and/or gas drilling operations. The deck may also support oil and/or gas production equipment for the production of oil and gas natural resources. Produced oil and/or gas may then be offloaded from the deck by, for example, pipeline to shore or a transport ship or barge and then moved to shore. The oil and gas may then be refined into usable petroleum products such as, for example, natural gas, liquefied petroleum gas, gasoline, jet fuel, diesel fuel, heating oil or other petroleum products.

The present invention has been described in connection with its preferred embodiments. However, to the extent that the foregoing description is specific to a particular embodiment or a particular use of the invention, this is intended to be illustrative only and is not to be construed as limiting the scope of the invention. On the contrary, it is intended to cover all alternatives, modifications, and equivalents that are included within the spirit and scope of the invention, as defined by the appended claims.

I claim:

1. An anchor installation apparatus, comprising:

a first elongated hollow element having a closed upper end, an open lower end, and a transverse cross sectional area;

a two-way flow valve located on said first elongated hollow element;

a second elongated hollow element having an open upper end, an open lower end, and a transverse cross sectional area substantially the same as that of said first hollow element; and a pipe end to pipe end connector for releasably connecting said open lower end of said first elongated hollow element to said open upper end of said second elongated hollow element.

2. The apparatus of claim 1, further comprising an attachment device fixed to the outer surface of said second elongated hollow element.

3. The apparatus of claim 1, further comprising a plurality of two-way flow valves located on said first elongated hollow element.

4. The apparatus of claim 3, wherein said two-way flow valves are attached to said closed upper end of said first elongated hollow element, said valves adapted to regulate the flow of fluid from one side of said closed upper end to the other side of said closed upper end of said first elongated hollow element.

5. The apparatus of claim 4, wherein said first and second elongated hollow elements have a cylindrical transverse cross sectional area.

6. The apparatus of claim 5, wherein said pipe end to pipe end connector is selected from the group consisting of a gravity connector, a threaded screwed connector, and a mechanical connector.

7. The apparatus of claim 6, wherein said pipe end to pipe end connector is selected from the group consisting of a slip joint, a stabbing guide, a mechanical latch, a coupling, a threaded pipe and a steel cable.

8. The apparatus of claim 5, wherein said first elongated hollow element, said second elongated hollow element, or both further include a longitudinal vane protruding from the outer surface of said tubular element.

9. A method for installing an anchor, comprising:

installing an anchor installation system at least partially into the floor of a body of water, said anchor installation system including (i) a first elongated hollow element having a closed upper end, an open lower end, and a transverse cross sectional area, (ii) a second elongated hollow element anchor having an open upper end, and open lower end, and a transverse cross sectional area substantially the same as that of said first elongated hollow element, (iii) a pipe end to pipe end connector for releasably connecting said open lower end of said first elongated hollow element to said open upper end of said second elongated hollow element and (iv) a two-way flow valve located on said first elongated hollow element; and releasing said first elongated hollow element from said second elongated hollow element.

10. The method of claim 9, wherein said installation step includes said anchor installation system further including a plurality of two-way flow valves located on said first elongated hollow element.

11. The method of claim 10, wherein said installation step comprises self-weight penetration.

12. The method of claim 10, wherein said installation step comprises applying a direct force to said anchor.

13. The method of claim 10, wherein said installation step comprises suction penetration.

14. The method of claim 10, further including retrieving said first elongated hollow element.

15. The method of claim 10, wherein said installation step includes said anchor installation system further including (v) an attachment device fixed to the outer surface of said second elongated hollow element anchor.

16. The method of claim 15, wherein said valves are attached to said closed upper end of said first elongated hollow element.

17. The method of claim 16, wherein said installation step includes said anchor installation system wherein said first and said second elongated hollow elements have a cylindrical transverse cross sectional area.

18. The method of claim 17, wherein said installation step includes said anchor installation system wherein said pipe end to pipe end connector is selected from the group consisting of a gravity connector, a threaded screwed connector, and a mechanical connector.

19. The method of claim 18, wherein said installation step includes said anchor installation system wherein said pipe end to pipe end connector is selected from the group consisting of a slip joint, a stabbing guide, a mechanical latch, a coupling, a threaded pipe and a steel cable.

20. The method of claim 10, wherein said installation step further includes:

a) positioning said anchor installation system at an inclined angle with respect to the sea floor, the top of said anchor installation system being inclined in a direction away from the direction of a lateral loading; and b) inserting said anchor installation system at least partially into said sea floor, said anchor installation system substantially maintaining said inclined angle.

21. The method of claim 10, wherein said installation step includes said anchor installation system wherein said first elongated hollow element, said second elongated hollow element, or both further include a longitudinal vane protruding from the outer surface of said elongated hollow element(s).

22. A method for installing an anchor, comprising:

installing an anchor installation system at least partially into the floor of a body of water, said anchor installation system including (i) a first elongated hollow element having a closed upper end, an open lower end, and a transverse cross sectional area, (ii) a second elongated hollow element anchor having an open upper end, open lower end, and a transverse cross sectional area substantially the same as that of said first elongated hollow element, (iii) means for releasably connecting said open lower end of said first elongated hollow element to said open upper end of said second elongated hollow element anchor, and (iv) a two-way flow valve located on said first elongated hollow element; and releasing said first elongated hollow element from said second elongated hollow element anchor.

23. The method of claim 22, wherein said installation step includes said anchor installation system further including a plurality of two-way flow valves located on said first elongated hollow element.

24. The method of claim 23, wherein said installation step comprises self-weight penetration.

25. The method of claim 23, wherein said installation step comprises applying a direct force to said anchor installation system.

26. The method of claim 23, wherein said installation step comprises suction penetration.

27. The method of claim 23, further including retrieving said first elongated hollow element.

28. The method of claim 23, wherein said installation step includes said anchor installation system wherein said first and said second elongated hollow elements have a cylindrical transverse cross sectional area.

29. The method of claim 28, wherein said installation step further includes:

a) positioning said anchor installation system at an inclined angle with respect to the sea floor, the top of said anchor installation system being inclined in a direction away from the direction of a lateral loading; and b) inserting said anchor installation system at least partially into said sea floor, said anchor installation system substantially maintaining said inclined angle.

30. The method of claim 28, wherein said installation step includes said anchor installation system wherein said first elongated hollow element, said second elongated hollow element, or both further include a longitudinal vane protruding from the outer surface of said elongated hollow element(s).

31. The method of claim 23, wherein said plurality of valves are attached to said closed upper end of said first elongated hollow element.

32. The method of claim 31, wherein said installation step includes said anchor installation system further including (v) load transfer means fixed to the outer surface of said second elongated hollow element anchor.

33. An anchor installation apparatus for use in installing an elongated hollow element into the floor of a body of water, comprising:

a first elongated hollow element having a closed upper end, an open lower end, and a transverse cross sectional area;

a two-way flow valve located on said first elongated hollow element;

a second elongated hollow element having an open upper end, an open lower end, and a transverse cross sectional area substantially the same as that of said first elongated hollow element; and means for releasably connecting said open lower end of said first elongated hollow element to said open upper end of said second elongated hollow element.

34. The apparatus of claim 33, further comprising a plurality of two-way flow valves located on said first elongated hollow element.

35. The apparatus of claim 34, further including load transfer means fixed to the outer surface of said second elongated hollow element.

36. The apparatus of claim 35, wherein said plurality of valves are attached to said closed upper end of said first elongated hollow element, said valves adapted to regulate the flow of fluid from one side of said closed upper end to the other side of said closed upper end of said first elongated hollow element.

37. The apparatus of claim 36, wherein said first and said second elongated hollow elements have a cylindrical transverse cross sectional area.

38. The apparatus of claim 37, wherein said first elongated hollow element, said second elongated hollow element, or both further include a longitudinal vane protruding from the outer surface of said elongated hollow element(s).

39. A method of producing offshore hydrocarbon resources, comprising:

a) anchoring an offshore structure to the seabed through use of an anchor installation system, said anchor installation system including (i) a first elongated hollow element having a closed upper end, an open lower end, and a transverse cross sectional area, (ii) a second elongated hollow element having an open upper end, and open lower end, and a transverse cross sectional area substantially the same as that of said first elongated hollow element, (iii) a load transfer device fixed to the outer surface of said second elongated hollow element, (iv) a pipe end to pipe end connector for releasably connecting said open lower end of said first elongated hollow element to said open upper end of said second elongated hollow element and (iv) a two-way flow valve located on said first elongated hollow element;

b) releasing said first elongated hollow element from said second elongated hollow element;

c) connecting said load transfer device to an offshore structure; and d) producing hydrocarbon resources.

40. The method of claim 39, further comprising (e) transporting said hydrocarbon resources to shore.

* * * * *